US008574057B2

(12) United States Patent
Lind et al.

(10) Patent No.: US 8,574,057 B2
(45) **Date of Patent: *Nov. 5, 2013**

(54) METHOD FOR PROVIDING A PLAYING CARD GAME SIMULATION BASED ON BINGO GAME RESULTS

(75) Inventors: Jefferson C. Lind, Austin, TX (US); Brian A. Watkins, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/566,801

(22) Filed: Aug. 3, 2012

(65) Prior Publication Data

US 2012/0315975 A1 Dec. 13, 2012

Related U.S. Application Data

(63) Continuation of application No. 12/367,227, filed on Feb. 6, 2009, now Pat. No. 8,235,787, which is a continuation of application No. 11/015,255, filed on Dec. 17, 2004, now abandoned.

(60) Provisional application No. 60/610,339, filed on Sep. 16, 2004.

(51) Int. Cl.
*A63F 9/24* (2006.01)

(52) U.S. Cl.
USPC ..... 463/19; 463/13

(58) Field of Classification Search
USPC ..... 463/13, 19
See application file for complete search history.

(56) References Cited

U.S. PATENT DOCUMENTS

| | | | |
|---|---|---|---|
| 5,476,259 | A | 12/1995 | Weingardt |
| 5,647,798 | A | 7/1997 | Falciglia |
| 5,732,950 | A | 3/1998 | Moody |
| RE35,864 | E | 7/1998 | Weingardt |
| 5,882,260 | A | 3/1999 | Marks et al. |
| 5,971,849 | A | 10/1999 | Falciglia |
| 6,079,711 | A | 6/2000 | Wei et al. |
| 6,409,173 | B1 | 6/2002 | Tri |
| 6,569,017 | B2 | 5/2003 | Enzminger et al. |
| 6,656,044 | B1 | 12/2003 | Lewis |
| 2002/0132661 | A1 | 9/2002 | Lind et al. |
| 2004/0048647 | A1 | 3/2004 | Lind et al. |

(Continued)

OTHER PUBLICATIONS

UPTO, BPAI's Decision on Appeal for U.S. Appl. No. 11/015,255, dated Sep. 2, 2008 (13 pages).

(Continued)

*Primary Examiner* — Corbett B Coburn
(74) *Attorney, Agent, or Firm* — Russell D. Culbertson, Esq.; J P Cody, Esq.

(57) ABSTRACT

A method includes displaying playing card face representations at an electronic player station. The displayed playing card face representations include card face representations that are included in a group of card face representations that has been assigned to the player in response to a bingo pattern achieved by the player in a bingo game. The player then selects one or more of the displayed card face representations to be replaced with one or more card face representations that are also included in the assigned group but have been concealed from the player. A prize is awarded to the player based on the card face representations remaining in the player's hand after replacement of the selected card face representations. This prize represents the player's prize for achieving the bingo pattern, but is based on the player's card hand produced after the player replaces the desired cards.

20 Claims, 9 Drawing Sheets

(56) References Cited

U.S. PATENT DOCUMENTS

| | | | |
|---|---|---|---|
| 2004/0152499 | A1 | 8/2004 | Lind et al. |
| 2005/0059469 | A1 | 3/2005 | Gail et al. |
| 2005/0101387 | A1 | 5/2005 | Wolf |
| 2006/0052148 | A1 | 3/2006 | Blair, Jr. et al. |

OTHER PUBLICATIONS

USPTO, BPAI's Decision on Request for Rehearing for U.S. Appl. No. 11/015,255, dated Jan. 2, 2009 (5 pages).

Dvorchak, Mark E., "Class II Gaming: Not Second Class," ERA White Paper, Nov. 2003 (11 pages).

Fey, Marshall, "Slot Machines: A Pictorial History of the First 100 Years," 1983, pp. 2, 12, 13, Liberty Belle Books, Reno, NV (4 pages).

METHOD FOR PROVIDING A PLAYING CARD GAME SIMULATION BASED ON BINGO GAME RESULTS

CROSS-REFERENCE TO RELATED APPLICATIONS

This application is a continuation of U.S. patent application Ser. No. 12/367,227, filed Feb. 6, 2009, and entitled "Method for Providing a Playing Card Game Simulation Based on Bingo Game Results," to be issued as U.S. Pat. No. 8,235,787, which is a continuation of U.S. patent application Ser. No. 11/015,255, filed Dec. 17, 2004 now abandoned, and entitled "Player Action Influenced Result Presentation in a Bingo Game," which claimed the benefit of U.S. Provisional Patent Application Ser. No. 60/610,339, filed Sep. 16, 2004, and entitled "Player Action Influenced Prize Distribution in a Bingo Game." The Applicants claim the benefit of U.S. patent application Ser. Nos. 11/015,255 and 12/367,227 under 35 U.S.C. §120, and claim the benefit of U.S. Provisional Patent Application Ser. No. 60/610,339 under 35 U.S.C. §119(e). The entire content of each of these prior applications is incorporated herein by this reference.

TECHNICAL FIELD OF THE INVENTION

This invention relates to electronically implemented games of chance such as electronic bingo games. More particularly, the invention relates to an electronically implemented bingo game that provides for active player participation in the manner in which the bingo results are presented.

BACKGROUND OF THE INVENTION

Bingo-type games are played with predefined bingo cards that each include a number of bingo designations such as Arabic numerals randomly arranged in a desired manner, commonly in a grid. The bingo designations for the cards are selected from a pool of available game designations. In more traditional bingo-type games, the cards are made up of paper or some other suitable material printed with the desired arrangement of bingo designations. These printed cards are purchased by players prior to the start of a game. Once all the cards for a game have been purchased, game designations from the available pool of game designations are selected at random. As the game designations are selected and announced in the game, the players match the randomly selected game designations with the designations printed on their respective card or cards. This matching and marking of matched designations on the bingo card is commonly referred to as "daubing" the card. The player first producing a predetermined pattern of matches between the randomly selected game designations and the printed card designations is considered the winner. Consolation prizes may be awarded to players having cards matched to produce consolation prize patterns at the time of the winning pattern.

There are numerous variations on the traditional bingo game. Some bingo-type games perform a draw to produce a set of game designations prior to the sale of printed bingo cards. These bingo-type games use printed cards like regular printed bingo cards, but with the card face concealed in some fashion. Once a player purchases one of these covered face bingo cards, the player can remove the cover and match the drawn designations to the printed card designations to identify if the matched designations produce some predetermined winning pattern. The first player to redeem a card with the winning pattern ends the game.

Another variation of the traditional bingo game is played with electronic bingo card representations rather than the traditional printed bingo cards. In these bingo-type games, each bingo card is represented by a data structure that defines the various card locations and designations associated with the locations. This bingo-type game is played through player stations connected via a communications network to a central or host computer system. The central computer system is responsible for storing the bingo card representations and distributing or communicating bingo card representations to players at the player stations. The player stations display the bingo cards defined by the card representations and also allow the players to daub or mark designation matches as game designations are announced in the game. A primary advantage of this electronic bingo game is that the games may be played at a much faster pace than is practical with traditional paper bingo. Another advantage of this electronic version of bingo is that the games can be administered and controlled from a remote location and actually played at a number of different bingo establishments.

Traditional bingo games, either played with paper cards or electronic card representations are limited in the manner in which the results of a game may be displayed and in player participation. Yet it is essential that the game retain the basic characteristics of a bingo-type game, namely that the game is played with predefined cards or card representations which the players match or daub against randomly generated game designations.

SUMMARY OF THE INVENTION

The present invention provides apparatus, methods, and program products for allowing player action to influence prize distribution in a bingo-type game. A method according to the present invention includes receiving a game result in a bingo-type game and displaying a result representation of the bingo-type game result at an electronic player station. The result representation may be correlated to the game result and includes a graphical representation unrelated to the bingo-type game. A player may make a choice to modify the graphical representation and adjust a prize value associated with the game result.

In certain embodiments, the method includes displaying an interactive game as the result representation of the bingo-type game. In the method, the interactive game may include a number of playing cards, that is, video generated playing card face representations, where a first portion of the cards are visible to the player and a second portion of the cards are concealed from the player. The interactive game may be a card game such as a draw poker game, blackjack, etc., that is played with about ten cards of which some of the cards may be completely concealed from the player and only the cards in play are visible. When the player makes a choice to modify the cards that are displayed to the player, the player choice may increase the game prize, decrease the game prize, or leave the game prize unchanged.

Various aspects of the present invention may also be realized through a method that involves receiving a game result in a bingo-type game and displaying a result representation for the game result in the bingo-type game at an electronic player station. The result representation may be correlated to the game result and includes a graphical representation unrelated to the bingo-type game. The method also includes receiving a player choice to modify the graphical representation so that a game prize may be identified according to both the game result and the player choice.

Still other aspects of the present invention may be realized through a method that includes displaying a result representation for a game result in a bingo-type game. The result representation comprises a set of cards displayed at an electronic player station. The set of cards may provide an interactive game unrelated to the bingo-type game to modify a game prize that corresponds to the game result. A player choice to modify the result representation may be received and the game prize may be identified according to both the game result and the player choice. One or more replacement cards may be displayed in response to the player choice.

In another form, the aspects of the invention may be found in a system having a processor to produce a game result in a bingo-type game. The system may also include an electronic player station to interact with the processor and to receive the game result. A display device may be associated with the player station to display the game result as an interactive graphical representation unrelated to the bingo-type game. The interactive graphical representation provides an opportunity for the player to modify a prize that is associated with the game result. In certain embodiments, the electronic player station of the system may be configured to receive the game result transparently to the player at the player station.

A program product according to the present invention includes machine-readable instructions that, when executed, produce a game result in a bingo-type game and cause an electronic player station to display a result representation for the game result of the bingo-type game. The result representation may be configured to include a graphical representation unrelated to the bingo-type game. The machine-readable instructions may generate a game prize according to the game result and be configured to receive a player choice to modify the graphical representation. The player choice to modify the graphical representation may cause an adjustment in the game prize. In some embodiments, the player choice may be made as part of an interactive game in the graphical representation.

DESCRIPTION OF PREFERRED EMBODIMENTS

Figure 1:
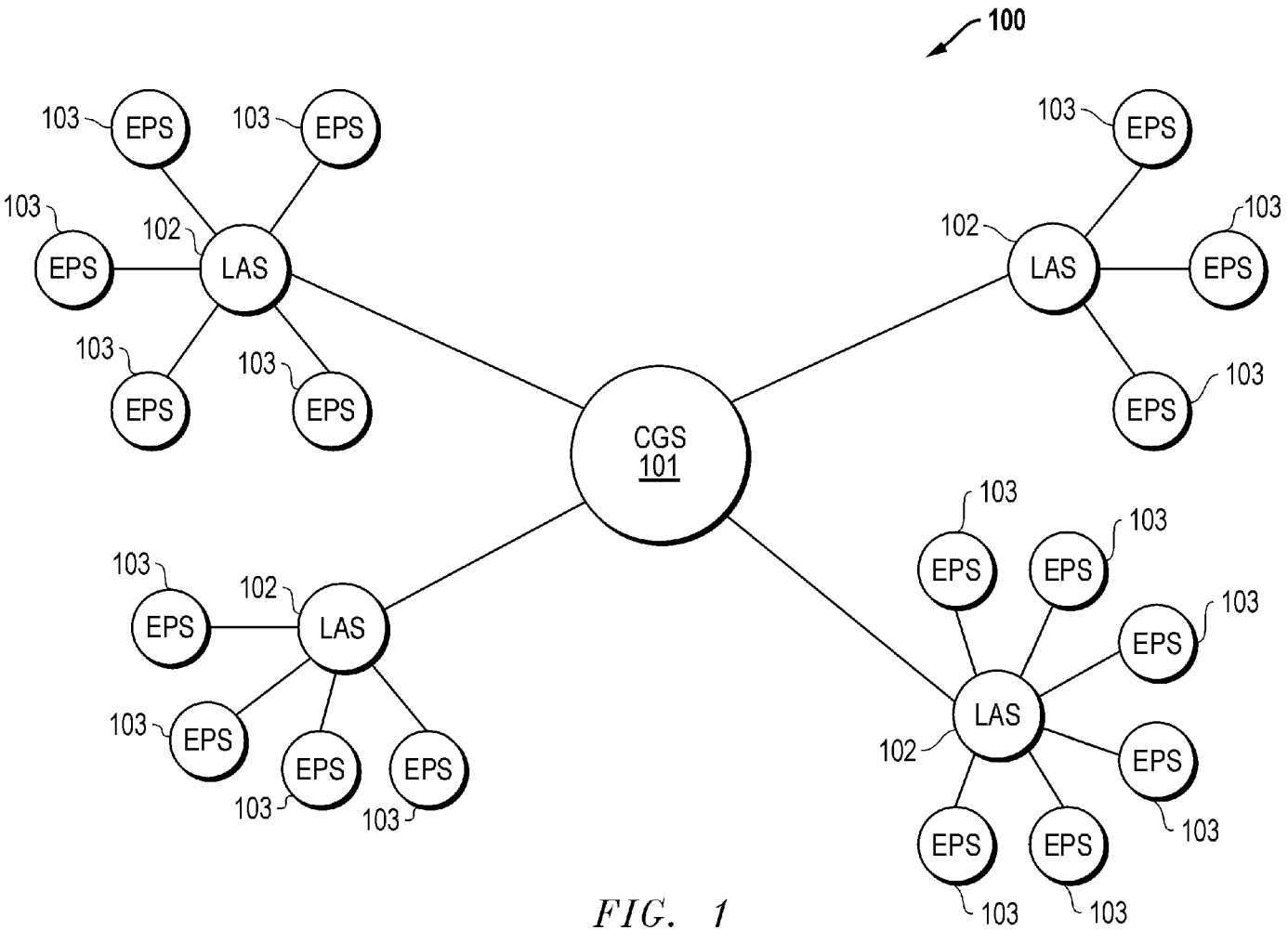
FIG. 1 is a high level diagrammatic representation of a bingo gaming system embodying principles of the present invention.

FIG. 1 is a high level diagrammatic representation of a bingo gaming system 100 embodying principles of the present invention. However, it should be noted that the invention may be used with any bingo gaming engine used to identify bingo results such as described in U.S. patent application Ser. No. 10/456,721, filed Jun. 6, 2003, and entitled "Method, System, and Program Product for Conducting Multiple Concurrent Bingo-Type Games." FIG. 1 shows a gaming system 100 including a central game server (CGS) 101 that cooperates with a number of other components to enable bingo players, preferably at many different remote gaming sites, to participate in bingo games. Each gaming site includes a local area server (LAS) 102 and a number of electronic player stations (EPSs) 103. In the normal operation of gaming system 100, a player at any EPS 103 in the system may participate in a given bingo game with players at any other EPSs 103 in the system. Thus, players at different gaming facilities may be grouped together for a given bingo game administered through system 100. Grouping together players from different gaming facilities for the play of a bingo game allows different bingo games to be played rapidly and minimizes the time that players must wait to receive the result of their participation in the bingo game.

The illustrated embodiment includes an arrangement for grouping players and/or game play requests for the play of a single bingo game to facilitate rapid play. This grouping includes limiting the number of players and/or game play requests included in a bingo game to reduce the time required to play the game. System 100 reduces the time between a game play request at one of the EPSs 103 and the return of results to the respective EPS sufficiently to allow a great deal of flexibility in how results in the bingo game are displayed to the player. In particular, the bingo game results may be displayed in some manner unrelated to bingo. For example, the bingo game results may be mapped to a display traditionally associated with a reel-type game (slot machine), to a display relating to a card game, or to a display showing a race such as a horse or dog race, etc. Preferred techniques for mapping bingo game results to displays associated with games or contests unrelated to bingo are described in U.S. patent application Ser. No. 10/060,643, filed Jan. 30, 2002, and entitled "Method, Apparatus, and Program Product for Presenting Results in a Bingo-Type Game." The entire content of this prior application is hereby incorporated herein by this reference. It should be appreciated that rapid play of bingo games may be facilitated with the bingo systems disclosed herein.

System 100 rapidly groups players and/or game play requests and starts one game after another so that multiple games may be in play at any given time. That is, once a first group of players or game play requests has been assigned to a bingo game offered through system 100, the system proceeds to concurrently administer a bingo game for the first group of players or game play requests and also begins grouping players or game play requests for a next bingo game. System 100 does not necessarily wait for one bingo game to be completed before starting to collect players or game play requests for, and actually beginning play in, the next bingo game. The number of players or game play requests grouped for the play of bingo games according to the present invention may be limited to reduce the time required for grouping. For example, each bingo game offered through gaming system 100 may be limited to between 2 to 20 players or game play requests, with the preferred number for any given game being from 10 to 15. Where system 100 includes numerous EPSs 103 at the various remote locations, for example, EPSs on the order of several thousand EPSs, hundreds of individual bingo games may be in process at any given time through the gaming system.

Regardless of the rapid play facilitated by system 100 and regardless of the manner in which the bingo game results are displayed, the underlying game remains a standard bingo game played in the traditional sequence of play for bingo games. That is, each player obtains or is assigned a bingo card or bingo card representation, all bingo cards in play in the game are daubed or checked for matches with a randomly generated sequence of designations (for example, designations produced in a ball draw or produced by a random number generator), and the first card in the game to match the sequence of designations to produce the game ending winning pattern wins the bingo game. Additional prizes may be awarded for other patterns that may be produced in the course of the bingo game. According to the present invention the prizes to be awarded may be modified according to a player input after an initial result representation graphic is displayed to the player.

The mapping of different prizes to various bingo patterns that may be produced in the course of a bingo game in system 100 may be accomplished as described in U.S. patent application Ser. No. 10/238,313, the entire content of which is incorporated herein by this reference. Mapping according to this invention is for a range of prizes and player choices that may affect the final awarded prize.

CGS 101 may comprise one or more computer systems (not shown) that may each include one or more processors, nonvolatile memory, volatile memory, a user interface arrangement, and a communications interface, all connected to a system bus. It will be appreciated that the user interface arrangement may include a number of different devices such as a keyboard, a display, and a pointing device such as a mouse or trackball for example. Alternatively to the integrated user interface arrangement, a user interface for CGS 101 may be provided through a separate computer in communication with the CGS. Regardless of the particular configuration for CGS 101, in the normal operation of system 100, the CGS functions to group players for participation in bingo games offered through the system, produces or obtains sequences of designations (ball draws, for example) for the play of the bingo games, checks for the results in the bingo games, and communicates the results to LASs 102.

As used in this disclosure any sequence of designations that may be matched against bingo cards or card representations in the present gaming system will be referred to as a "ball draw" regardless of how the sequence is actually generated. Under this definition, it will be appreciated that a ball draw may be produced by a random number generator, a pseudo random number generator, or any other suitable device or system, and not necessarily a physical ball draw device.

Each LAS 102 included in system 100 may comprise a computer system having the same basic structure as described above. That is, each LAS 102 may include one or more processors, nonvolatile memory, volatile memory, a user interface arrangement, and a communications interface all connected to a system bus. As with CGS 101, the user interface for the respective LAS 102 may be provided through a separate computer and communications with the LAS rather than the integrated user interface arrangement. Regardless of the specific configuration of the LAS 102, each LAS may serve to transfer or relay information from its respective EPSs 103 to CGS 101 and transfer or relay information from the CGS to the LAS's respective EPSs. Each LAS according to the present invention may also have the ability to group players and actually play bingo games in certain situations. For example, where one LAS 102 serves a large number of EPSs 103, the LAS may group players or game play requests from its respective EPSs during a time of high player activity, obtain or produce a ball draw, identify results, and return results to the EPSs rather than having the CGS 101 perform these tasks. Also, each LAS 102 may be configured to perform the tasks normally performed by CGS 101 in the event the communications link between the respective LAS and CGS is degraded below a certain level or is severed altogether.

It is to be appreciated that alternative bingo engines may operate in systems similar to the system 100 where winning and/or losing bingo game results may be presented to bingo players in formats other than a bingo card daubed with bingo patterns. For example, rather than presenting a bingo card to the player with the game result indicated by the pattern on the face of the bingo card, the bingo game results may be presented to the player in a manner unrelated to a bingo game such as by a particular pattern of reels in a slot machine or by a group of cards to represent each different bingo pattern that a bingo card may present upon daubing, etc.

In the present invention, results of different bingo patterns are displayed to bingo players as different card groupings. Because different bingo patterns represent different prizes or levels of winning combinations in the bingo game, particular card groupings may represent particular bingo patterns. To add a level of excitement to the alternative presentation of a card grouping for a resulting bingo pattern, players may be offered the opportunity to arrange the cards of the card grouping differently in an attempt to obtain an optimum prize that is associated with the particular bingo pattern. In other words, bingo players may be given a group of cards that correspond to the bingo pattern that the player received in the bingo game, and the player may then arrange the group of cards in an attempt to obtain an optimum pattern of cards or hand of cards to receive the optimum prize for the particular bingo pattern. When the player arranges the cards in a sub-optimal arrangement, the hand corresponds to a sub-optimal prize for the particular bingo pattern that the player received.

Figure 2:
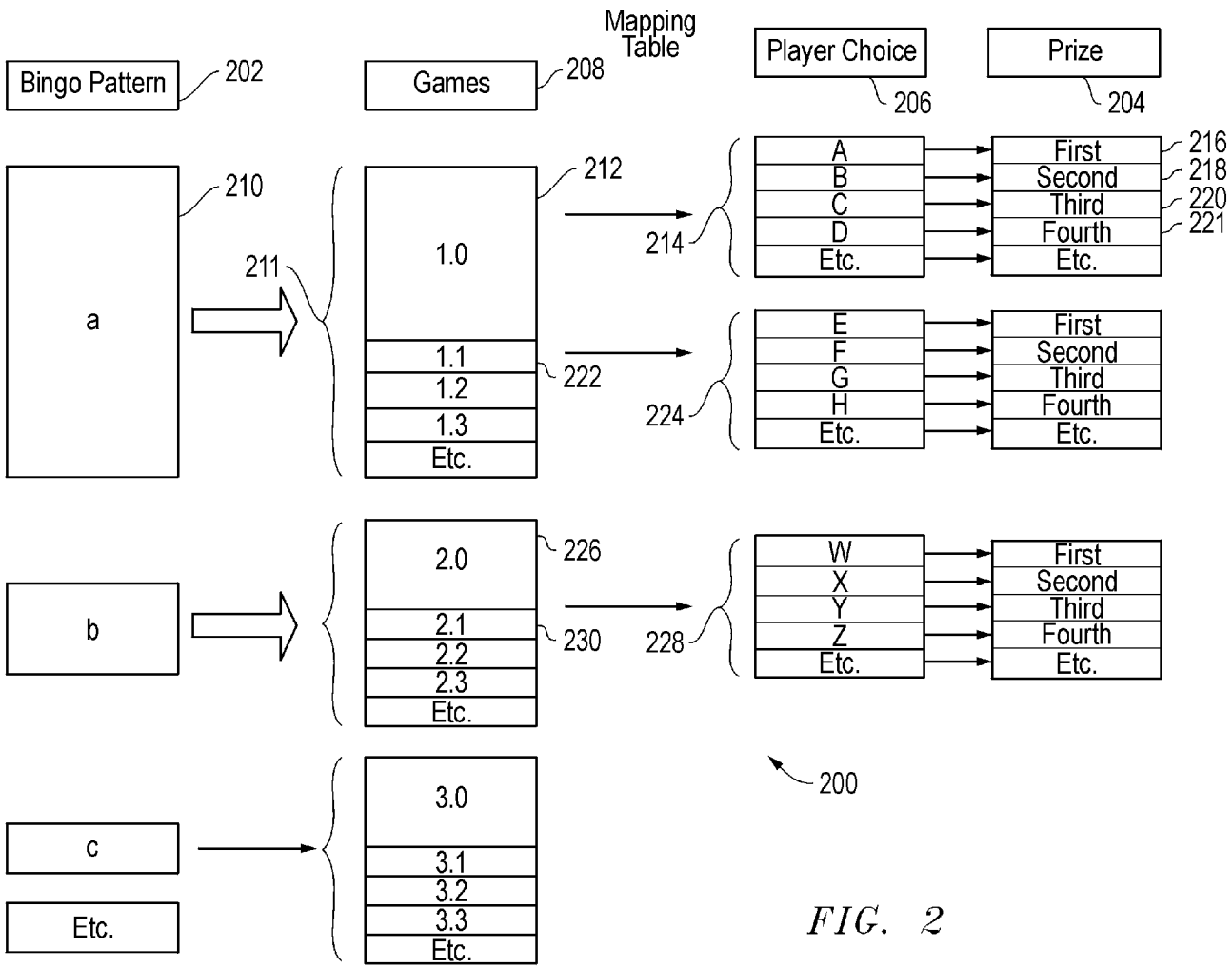
FIG. 2 is a mapping table representing progression from potential results in a bingo gaming system to selection of a prize influenced by player choice after an initial game of bingo.

FIG. 2 is a mapping table 200 representing progression from possible results in a bingo game to a potential prize that a player may receive for the result. A bingo card pattern column 202 represents different bingo patterns, 'a', 'b', 'c', etc., that a player may daub on a bingo card representation 210 that is in play in the bingo game. The bingo card representation 210 may be stored or generated at LAS 102, CGS 101, EPS 103, a combination of these locations, or at a bingo engine outside of system 100 of FIG. 1. A prize selection column 204 represents the eventual prize that a player may receive for a bingo pattern from bingo pattern column 202 in the bingo game played with bingo card representation 210. Prize selection column 204 may be influenced by a player choice in another game represented by a game taken from a game column 208. Game column 208 may be mapped to a player choice column 206 that represents different player choices that may be made in a particular game from game column 208. Game column 208 includes different groups of games 211 that a player may enter after the bingo game is played with bingo card representation 210.

After a bingo pattern is obtained on a bingo card representation, a player may be given the option to choose another game to enter for further prize selection. The games that the player may be allowed to choose from may be a certain type of card game such as poker or blackjack, a certain type of race game such as a simulated horse or dog race, or another type of game that requires some type of player action. Alternatively, the player may be assigned a game by system 100. The game may be assigned based on past games that the player has played, based on a random selection of a game, based on the type of gaming machine where the player is located, or based on some other similar reason.

The different games are represented by the different groups of games 211 of column 208. Each of the different groups of games 211 may include different variations for the particular game. Thus, although a player may select or be assigned the same game multiple times, the player may receive a different variation of the game each time the game is selected.

In the illustrated embodiment, during a bingo game, different bingo patterns may appear on bingo card representation 210 as illustrated in column 202. When the 'a' bingo pattern is identified on bingo card representation 210 after daubing, bingo card representation 210 may be mapped to a first group of games 211. When the 'b' bingo pattern is identified, bingo card representation 210 may be mapped to a second group of games 211, and when the 'c' bingo pattern is identified, bingo card representation 210 may be mapped to a third group of games 211. So as not to obscure the description of the invention herein, the first, second, and third group of games 211 will be assumed to represent different variations of card combinations in a card game. Different hands of the card game are represented in each of the groups of games 211.

In one embodiment, through a combination of assignments and/or player selections, the 1.0 game 212 may be randomly selected from the first group of games 211 to map to bingo card representation 210 when the 'a' bingo pattern is daubed. However, other games in the first group of games 211, for example 1.1, 1.2, 1.3, etc., may have been selected to map to the 'a' bingo pattern for various reasons such as to avoid duplication of a hand of cards in the group of game variations 211 that may be mapped to the 'a' bingo pattern.

The 1.0 game 212 may be a hand of card representations in which a group of player choices 214 are available to possibly improve the hand. Player choices 214 of player choice column 206 are arranged from a preferred choice for the best prize to a less than preferred choice for less than the best prize. For example, a player may make the "A" choice from the group of player choices 214 and find that they receive a First Prize 216 from prize selection column 204. When the player makes the "B" choice from the group of player choices 214, the player may receive a Second Prize 218 from prize selection column 204. When the player makes the "C" choice, the player may receive a Third Prize 220, and so forth.

One the other hand, through a combination of assignments and/or player selections, the 1.1 game 222 may be randomly selected from the first group of games 211 to map to the bingo card representation 210 when the 'a' bingo pattern is daubed. Like the 1.0 game 212, the 1.1 game 222 may be a hand of card representations; however, the 1.1 hand of card representations may be different than the 1.0 hand and a different group of player choices 224 are available for final prize distribution. That is, the group of player choices 224 are arranged from the preferred choice of "E" to less than preferred choice "F", choice "G", "H", and so forth. The awarded prizes from prize column 204 correspondingly progress from a First Prize down. Other mapping combinations of bingo pattern column 202 to games column 208 will be appreciated by one of ordinary skill in the art and viewing the present disclosure, but for purposes of expediency have not been described in detail herein. However, as discussed further herein, numerous variations in the mappings of FIG. 2 will become apparent to one of ordinary skill in the art in viewing FIGS. 3-8.

Figure 3:
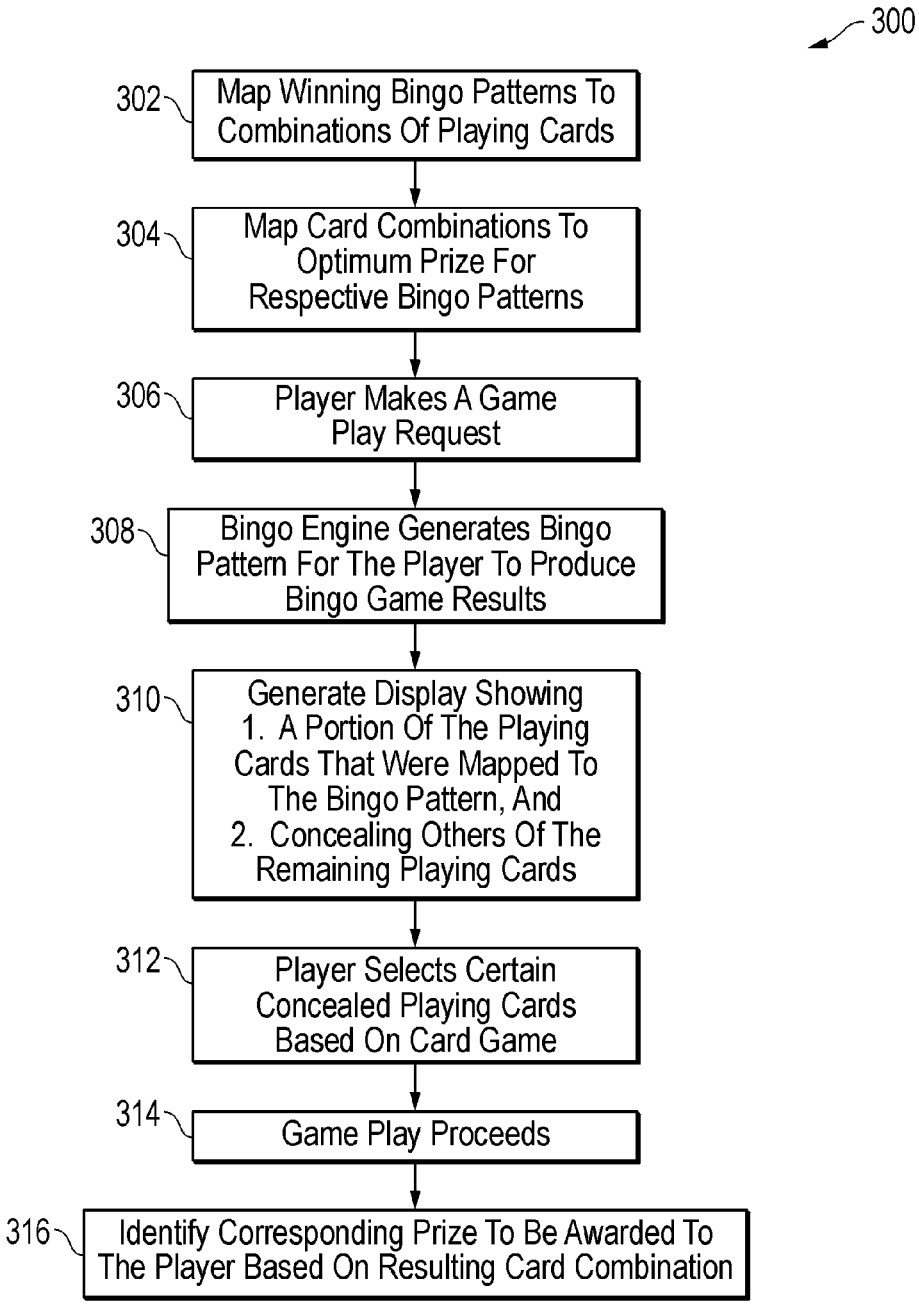
FIG. 3 is a flow chart illustrating a gaming method embodying the principles of the present invention.

FIG. 3 is a flow diagram illustrating a gaming method 300 embodying principles of the present invention. For purposes of example, the flow diagram will be described in view of the embodiment in which different bingo patterns of a single bingo card map to different combinations of playing cards. At process block 302, different bingo patterns of a particular bingo card are mapped to different combinations of playing cards. Thus, each combination of playing cards in a group of combinations may comprise a different combination of playing cards for the same card game. This mapping is preferably transparent to the player of the bingo game. At process block 304, different card combinations are mapped to different potential prizes to be available for the particular bingo pattern. For example, the 'a' bingo pattern of FIG. 2 may identify a bingo pattern that maps to the 1.1 game 222 of the first group of games 211. The 1.1 game 222 maps to a combination of player choices 224 for a hand of card representations, which in turn map to different prizes from prize column 204. At process block 306, the player may be presented with a choice of games to play such as draw poker, blackjack, etc., when a bingo pattern is received. The chosen game may be played with different combinations of playing cards that are mapped to particular bingo patterns that the player may receive in the bingo game.

At process block 308, a bingo engine generates a result for the player when the player's bingo card representation is daubed. Upon daubing, at process block 310, the player may view a display of at least a portion of a card combination that was mapped to the daubed bingo pattern. The remaining cards of the card combination that was mapped to the daubed bingo pattern are preferably concealed from the player. In an effort to receive an optimum prize for the bingo pattern that the player received in the bingo game, at process block 312 the player may select certain card representations to be replaced by certain concealed playing cards. The game is continued at process block 314 where the replacement cards, if any, are utilized in the game.

For example, in a draw poker game, the selected cards may be replaced with others of the concealed cards. In a blackjack game, cards may be added to the player's hand in an attempt to score a winning hand.

Based on the player's resulting hand of cards, a corresponding prize may be awarded to the player at process block 316. If the resulting hand of cards is the optimum hand for the particular card combination, the prize may be improved to become the optimum prize. Likewise, if the resulting hand from the selected card combination is sub-optimum, the prize may be reduced to a sub-optimum prize. In addition, the prize may remain the same after the player selection of concealed cards.

Figure 4A:
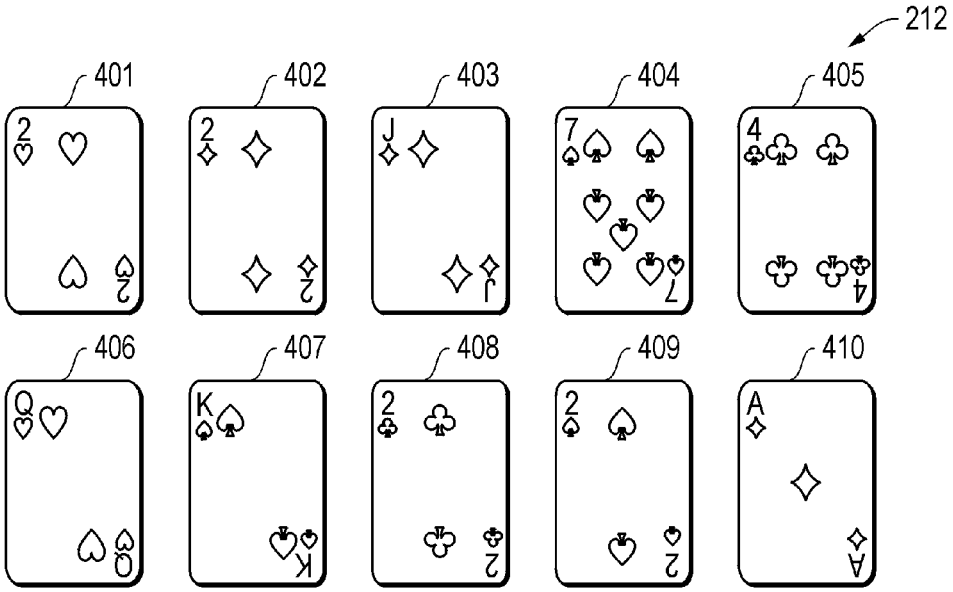
FIGS. 4A-4B illustrate an example of a game that may offer a player choice embodying the principles of the invention.
Figure 4B:
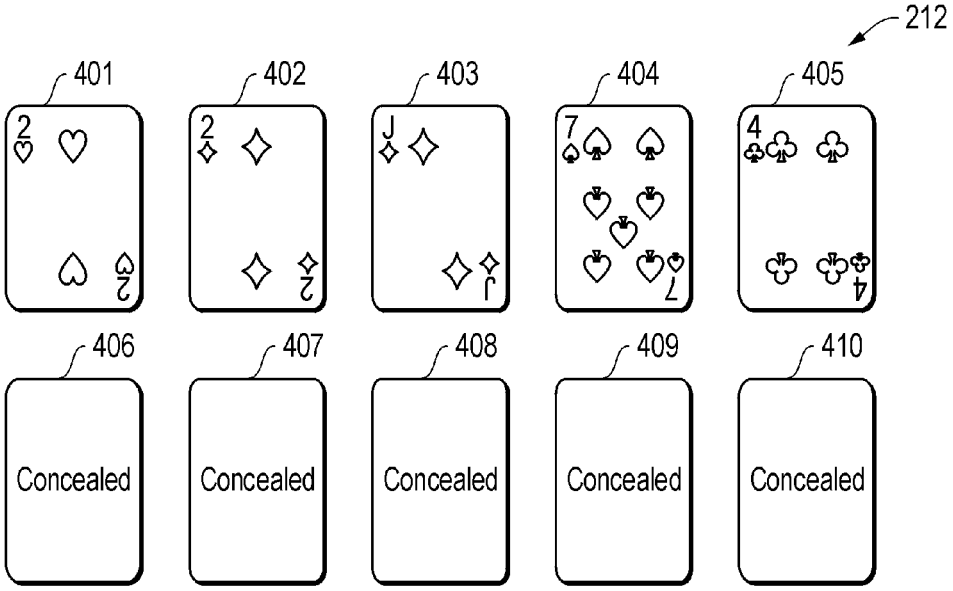

FIGS. 4A-4B illustrate an example of a game that may offer a choice to a player regarding a result of a bingo game. FIG. 4A illustrates one possible variation of ten cards that may be used to make up the game from the card combination 212 as described herein regarding FIG. 2. The illustrated cards 212 may comprise the following ten cards: a two of hearts 401, a two of diamonds 402, a jack of diamonds 403, a seven of spades 404, a four of clubs 405, a queen of hearts 406, a king of spades 407, a two of clubs 408, a two of spades 409, and an ace of diamonds 410. Of course, different groups of cards 212 may have different combinations of cards or a different number of cards, and the ten cards 212 may be used for different games. However, for purposes of expediency and understanding principles of the present invention, the ten cards 212 will be described as they may be used in a draw poker game.

FIG. 4B illustrates the ten cards 401-410 as they may appear to a player of the draw poker game. Of course, in a preferred embodiment the player may not realize that only ten cards make up the draw poker game because the concealed cards may not be visible to the player. The faces of cards 401-405 are visible to the player while the faces of cards 406-410 are concealed from the player's view and cards 406-410 may be completely out of the view of the player. If the player chooses to accept the five visible cards as being the hand that the player would like to keep in the game, FIG. 4B also illustrates the player's choice for the card combination 212 of FIG. 2. The hold choice for the card combination provides the player with a pair of twos 401 and 402 that may or may not be the best hand that the player could have obtained with a different combination of the ten cards 212. Prizes for the card combinations may be ranked according to the order of plays that are possible with the ten cards 212, the best hand of the ten cards 212 mapping to the best prize, the second best hand of the ten cards 212 mapping to the next best prize, etc.

Figure 5A:
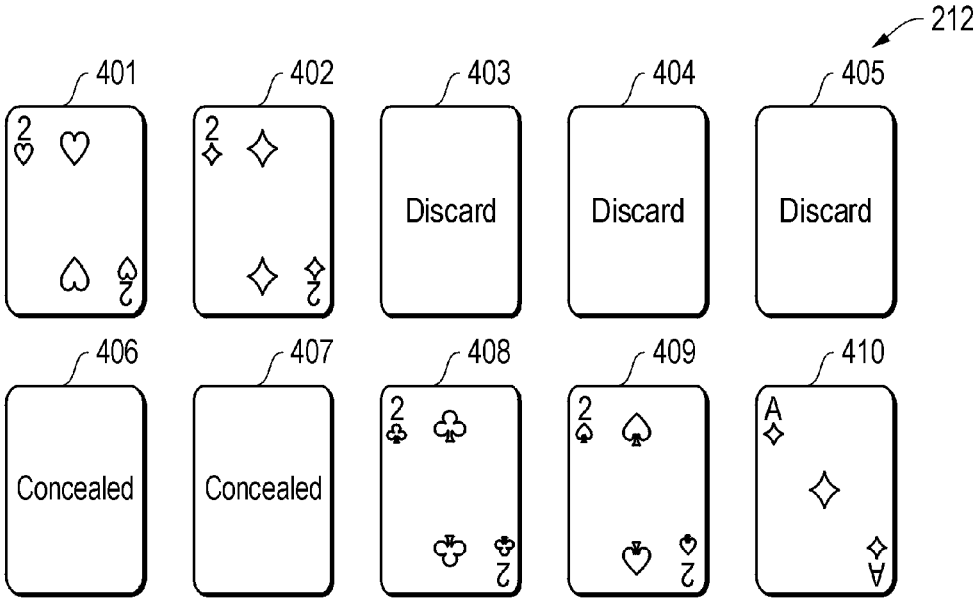
FIGS. 5A-5C use the same group of playing card face representations shown in FIG. 4A to illustrate game variations that may occur based on the player choices in the game.
Figure 5B:
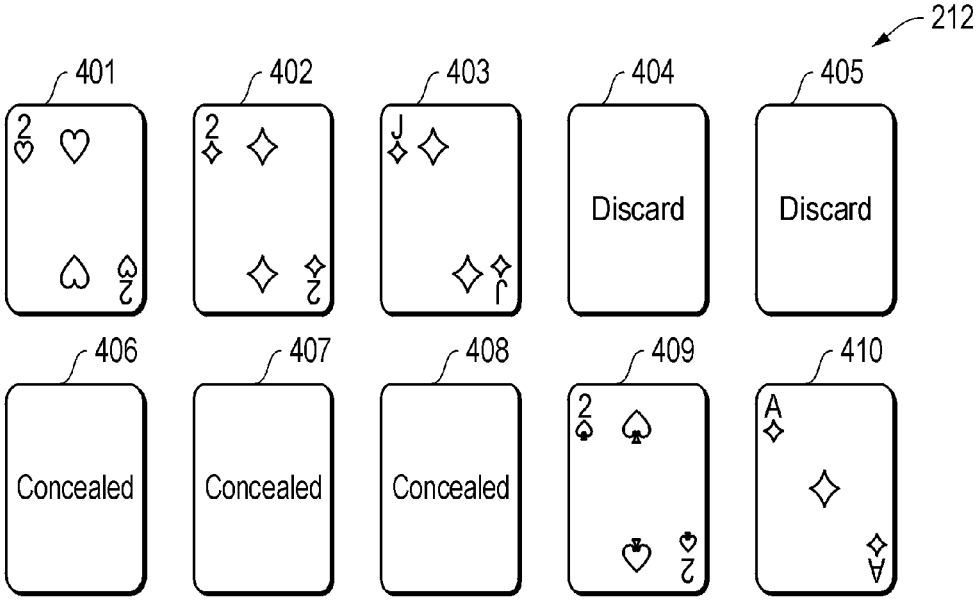
Figure 5C:
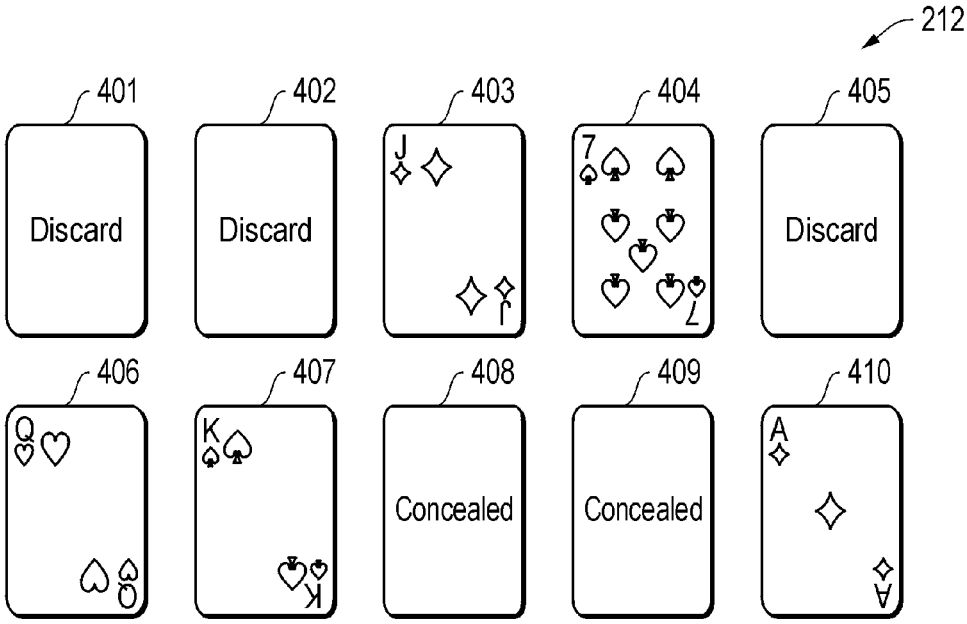

FIGS. 5A-5C illustrate card game results that may occur based on different player choices in the draw poker game of FIGS. 4A and 4B. In the example shown in FIG. 5A, the player has chosen to discard cards 403-405 in hopes of obtaining a better draw poker hand with the ten cards 212. Cards 403-405 are replaced by the newly visible cards 408-410. Thus, the five visible card faces 401, 402 and 408-410 now show the player's resulting hand to be four twos with cards 401, 402, 408, and 409, which happens to be the ideal/optimum hand for the ten cards of FIG. 4A. As illustrated in FIG. 2, this ideal hand may correspond to an "A" entry of player choices 214 which happens to map to a First Prize 216 from prize selection column 204.

In the example shown in FIG. 5B, the player chooses to discard cards 404 and 405, possibly in hopes of obtaining a flush. As illustrated, the five visible cards 401-403, 409, and 410 show a less than ideal hand for the ten cards 212, three twos with cards 401-402 and 409. This less than ideal hand may correspond to a "B" entry of player choices 214 which happens to map to a Second Prize 218 from prize selection column 204.

The example shown in FIG. 5C illustrates the result when the player chooses to discard cards 401, 402 and 405. This play results in a hand containing cards 403, 404, 406, 407, and 410, which happens to be a poker hand of no value. This combination of the ten cards 212 may correspond to a "D" entry from the possible player choices 214 because the hold combination of FIG. 4B would correspond to the "C" entry. As illustrated in FIG. 2, the 'C' entry maps to a third prize 220 from prize column 204, and the 'D' entry maps to a Fourth Prize 221. It should be appreciated that Fourth Prize 221 may be no prize at all.

Figure 6A:
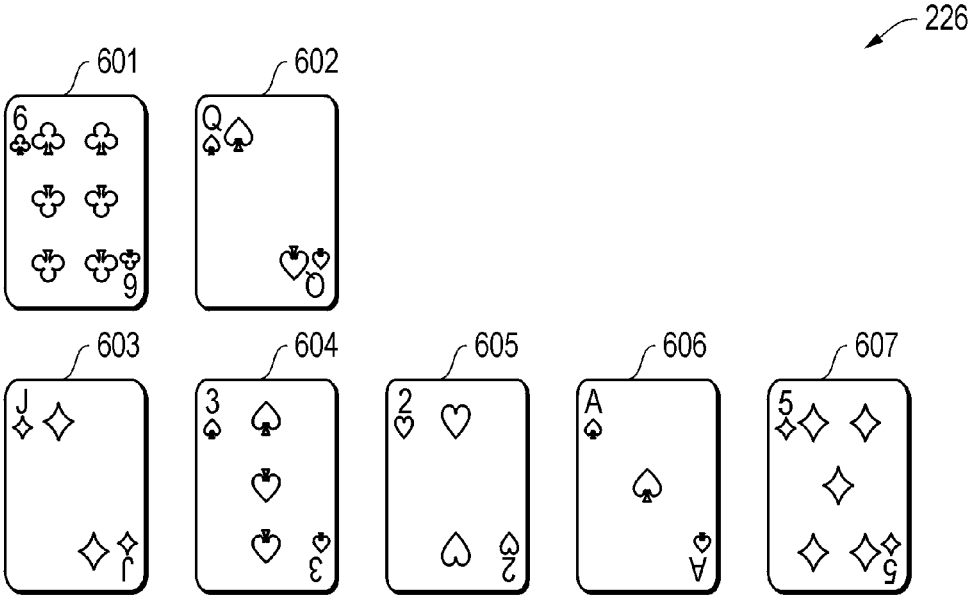
FIGS. 6A-6B illustrate another example of a game that may offer a player a choice in accordance with principles of the invention.
Figure 6B:
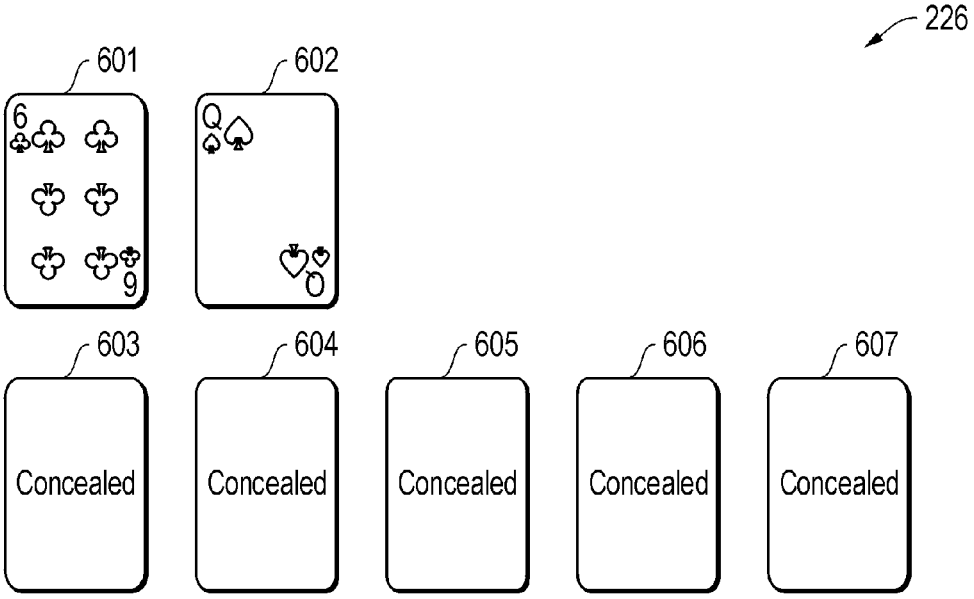

FIGS. 6A-6B illustrate an example of a card combination for blackjack in the game that may offer a player choice in accordance with principles of the invention. FIG. 6A illustrates one possible variation of seven cards that may be used to make up a second level game from a card combination 226 (see FIG. 2) as described herein. The illustrated card combination 226 comprises the following seven cards: a six of clubs 601, a queen of spades 602, a jack of diamonds 603, a three of spades 604, a two of hearts 605, an ace of spades 606, and a five of diamonds 607. Of course, as with the ten card combination 212 of FIG. 4, card combination 226 may have different combinations such as a combination having less or more than seven cards, the seven cards 226 being used for different games, etc. In this instance, the seven cards 226 are described as they may be used in a blackjack game. As blackjack scores are compared to a dealer hand to identify whether a score is a winning hand, the dealer hand may be displayed near the display of card combination 226. However, variations of blackjack are contemplated in which the player choices 228 (see FIG. 2) map to different prizes of prize column 204. For example, the highest score possible with card combination 226 after the player makes a choice may map to a First Prize, the next highest score for the cards of card combination 226 may map to a second prize, etc.

FIG. 6B illustrates the seven cards 601-607 as they may appear to a player of the blackjack game. The faces of cards 601 and 602 are initially visible to the player while the faces of cards 603-607 are initially concealed from the player's view. In a preferred embodiment, as with the draw poker game of FIGS. 4A and 4B, cards 603-607 may be concealed altogether. If the player chooses to accept the two visible cards as being the hand that the player would like to keep in the game, FIG. 6B illustrates the player choice for card combination 226. This choice combination provides the player with a sixteen point total that, to the player's knowledge, may or may not be the best hand that the player could obtain with the seven cards 226. A separate display of a dealer hand may influence a player's decision whether to "hit" the visible cards 601 and 602 with another of the cards 603-607. It should be noted that card combinations 212 and 226 may comprise more than the number of cards illustrated in FIGS. 4A and 4B and 6A and 6B.

Figure 7A:
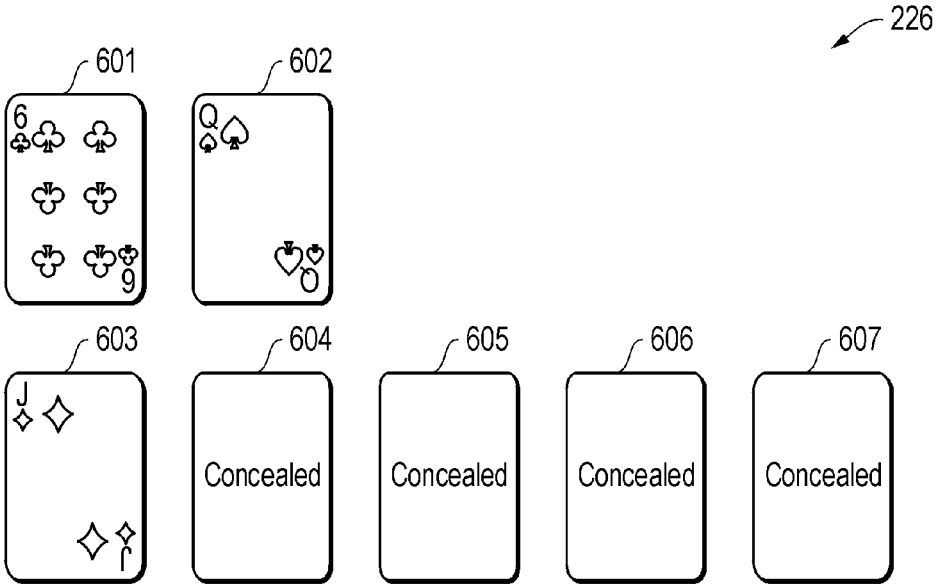
FIGS. 7A-7B use the same set of playing card face representations shown in FIG. 6A to illustrate game variations that may result from the player choices in the game.
Figure 7B:
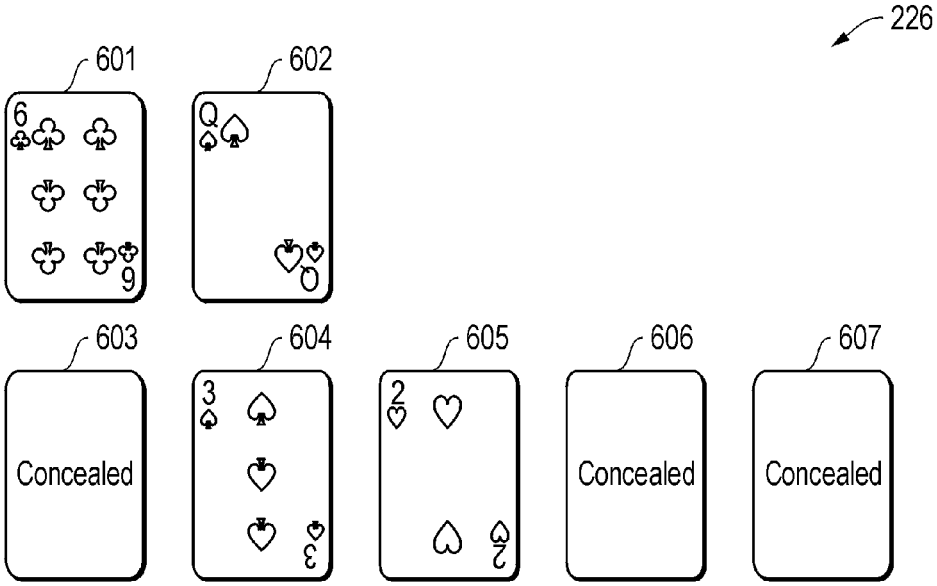

FIGS. 7A-7B illustrate game result variations that may occur from the player choices in the blackjack game of FIGS. 6A and 6B. FIG. 7A illustrates the result of the player choosing to hit or combine card 603 with cards 601 and 602. As illustrated by their faces, the three cards 601-603 add to a total of 26 which results in the player losing the blackjack game. Similar to the mapping of the draw poker game, the losing blackjack hand may map to a lesser prize than the prize that was available prior to the player choosing to add a card to their hand.

FIG. 7B illustrates a more favorable result for the player of the blackjack game. The player may select card 604 to combine with the sixteen point combination of cards 601 and 602. This results in a nineteen point total, which, of course, is better than leaving all of the concealed cards concealed or adding card 603 to the hand. Thus, the player would earn a better prize than if all concealed cards had been left concealed. However, if the player chooses to hit or view yet another card 605, the player obtains a further improved hand and a still better prize from prize column 204 of FIG. 2.

Figure 8:
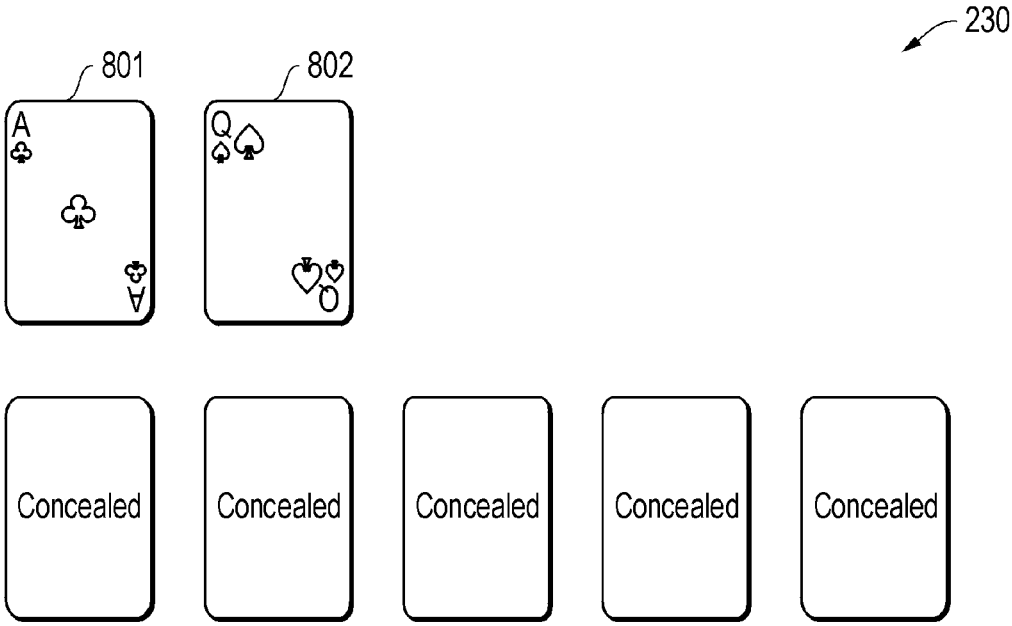
FIG. 8 illustrates another variation of a card combination for the game of FIG. 6.

FIG. 8 illustrates another possible variation of seven cards for a set of cards 230 (see FIG. 2) that may be generated or predefined from the 'b' pattern on card representation 210. Seven cards 230 may be distributed to the player such that the player obtains a blackjack combination with cards 801 and 802 and no further cards need be selected. Thus, in order to receive the maximum prize, the player choice from the group of available choices 228 (see FIG. 2) should be to hold. As will become apparent to one of ordinary skill in the art and viewing the disclosed embodiments, further variations to the games subsequent the initial bingo game are possible and are within the scope of the appended claims.

The above described preferred embodiments are intended to illustrate the principles of the invention, but not to limit the scope of the invention. Various other embodiments and modifications to these preferred embodiments may be made by those skilled in the art without departing from the scope of the invention.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The invention claimed is:

1. A method including:

(a) assigning a first subset of card face representations for a player in a bingo game, the first subset of card face representations including a first portion of card face representations and a second portion of card face representations, the first subset of card face representations representing a subset of a standard deck of playing cards, and the assignment of the first subset of card face representations being performed by a data processing system responsive to the player achieving a bingo pattern in the bingo game;

(b) displaying the first portion of the first subset of card face representations to the player through a display device associated with a player station for the player while concealing the second portion of the first subset of card face representations, the first portion of the first subset of card face representations representing to the player an initial deal to the player in a playing card game;

(c) receiving a player selection entered by the player through the player station;

(d) responsive to the player selection, displaying one or more card face representations from the second portion of the first subset of card face representations as part of a playing card hand for the player in the playing card game, the playing card hand produced by one or more card face representations from the first portion of the first subset of card face representations and the one or more displayed card face representations from the second portion of the first subset of card face representations; and (e) awarding a prize to the player for the bingo game, the value of the prize (i) being based on the hierarchical value of the playing card hand and thereby (ii) being correlated to the one or more card face representations displayed from the second portion of the first subset of card face representations responsive to the player selection.

2. The method of claim 1 wherein the first portion of the first subset of card face representations represents to the player an initial deal in a draw poker game, and the player selection selects one or more card face representations from the first portion of the first subset of card face representations to be replaced by a respective card face representation from the second portion of the first subset of card face representations.

3. The method of claim 2 wherein the second portion of the first subset of card face representations includes at least as many card face representations as are in the first portion of the first subset of card face representations.

4. The method of claim 3 wherein each card face representation in the second portion of the first subset of card face representations corresponds to a respective one of the card face representations included in the first portion of the first subset of card face representations so that the selection of a respective one of the card face representations included in the first portion of the first subset of card face representations causes the respective corresponding card face representation from the second portion to be displayed to the player as replacing the selected card face representation from the first portion of the first subset of card face representations.

5. The method of claim 1 wherein the first portion of the first subset of card face representations represents to the player an initial deal in a poker game, and the player selection causes a card face representation from the second portion of the first subset of card face representations to be displayed as part of the hand for the player in the poker game.

6. The method of claim 1 wherein the first portion of the first subset of card face representations represents to the player an initial deal for the player in the game of blackjack, and the player selection selects one or more card face representations from the second portion of the first subset of card face representations to be added to the initial deal in the blackjack game.

7. The method of claim 1 wherein the first portion of the first subset of card face representations represents to the player an initial deal for the player in the game of blackjack and an initial deal for a dealer in the game of blackjack.

8. The method of claim 1 wherein the first subset of card face representations is assigned from a number of different subsets of card face representations, each subset of card face representations including a respective first portion of card face representations and a respective second portion of card face representations, and each subset of card face representations representing a different subset of a standard deck of playing cards.

9. The method of claim 8 wherein the number of different subsets of card face representations includes at least four subsets of card face representations.

10. The method of claim 1 further including, prior to the assignment of the first subset of card face representations responsive to the player achieving the bingo pattern in the bingo game, correlating the first subset of card face representations to the bingo pattern.

11. A method including:

(a) displaying a first portion of a first subset of card face representations to a player in a bingo game through a display device associated with a player station for the player, the first subset of card face representations comprising a subset of a standard playing card deck and having been assigned for the player by a data processing system responsive to the player achieving a bingo pattern on a bingo card representation for the player, the displayed first portion of the first subset of card face representations representing to the player an initial deal to the player in a playing card game;

(b) concurrently with displaying the first portion of the first subset of card face representations to the player, concealing a second portion of the first subset of card face representations;

(c) receiving a player selection;

(d) responsive to the player selection, displaying one or more card face representations from the second portion of the first subset of card face representations as part of a playing card hand for the player in the playing card game; and (e) awarding a prize to the player for the bingo game, the value of the prize being correlated to the hierarchical value of the playing card hand including one or more card face representations from the first portion of the first subset of card face representations and one or more card representations from the second portion of the first subset of card face representations displayed responsive to the player selection.

12. The method of claim 11 wherein the first portion of the first subset of card face representations represents to the player an initial deal in a draw poker game, and the player selection selects one or more card face representations from the first portion of the first subset of card face representations to be replaced by a respective card face representation from the second portion of the first subset of card face representations.

13. The method of claim 12 wherein each card face representation in the second portion of the first subset of card face representations corresponds to a respective one of the card face representations included in the first portion of the first subset of card face representations so that the selection of a respective one of the card face representations included in the first portion of the first subset of card face representations causes the respective corresponding card face representation from the second portion of the first subset of card face representations to be displayed to the player as replacing the selected card face representation from the first portion of the first subset of card face representations.

14. The method of claim 11 wherein each card face representation in the second portion of the first subset of card face representations corresponds to a respective one of the card face representations included in the first portion of the first subset of card face representations so that the selection of a respective one of the card face representations included in the first portion of the first subset of card face representations causes the respective corresponding card face representation from the second portion to be displayed to the player as replacing the selected card face representation from the first portion of the first subset of card face representations.

15. The method of claim 11 wherein the first portion of the first subset of card face representations represents to the player an initial deal in a poker game, and the player selection causes a card face representation from the second portion of the first subset of card face representations to be displayed as part of the hand for the player in the poker game.

16. The method of claim 11 wherein the first portion of the first subset of card face representations represents to the player an initial deal for the player in the game of blackjack, and the player selection selects one or more card face representations from the second portion of the first subset of card face representations to be added to the initial deal in the blackjack game.

17. A method including:

(a) responsive to a player achieving a result in a game, assigning a first set of items for the player, the first set of items including a first portion of items and a second portion of items, and the assignment of the first set of items being performed by a data processing system responsive to the player achieving a bingo pattern in the bingo game;

(b) displaying the first portion of items to the player through a display device associated with a player station for the player, and concurrently concealing the second portion of items;

(c) receiving a player selection entered by the player through the player station;

(d) responsive to the player selection, displaying one or more items from the second portion of items; and (e) awarding a prize to the player for achieving the result in the game, the value of the prize being correlated to the player selection.

18. The method of claim 17 wherein the first portion of items and the second portion of items includes the same number of items.

19. The method of claim 17 wherein at the time of the assignment of the set of items each item in the second portion of items corresponds to a respective one of the items included in the first portion of items so that the selection of a respective one of the items included in the first portion of items causes the respective corresponding item from the second portion of items to be displayed to the player as replacing the selected item from the first portion of items.

20. The method of claim 17 wherein at the time of the assignment of the set of items each item in the second portion of items corresponds to a respective one of the items included in the first portion of items.

* * * * *